US008459448B1

(12) United States Patent
Bussone

(10) Patent No.: US 8,459,448 B1
(45) Date of Patent: Jun. 11, 2013

(54) MATCH CONTAINER AND STRIKER FOR A MATCH HANDLE

(76) Inventor: Gregory Desi Bussone, Marquette, MI (US)

( * ) Notice: Subject to any disclaimer, the term of this patent is extended or adjusted under 35 U.S.C. 154(b) by 0 days.

(21) Appl. No.: 13/429,340

(22) Filed: Mar. 24, 2012

(51) Int. Cl.
*A24F 27/00* (2006.01)

(52) U.S. Cl.
USPC ..... 206/137; 206/134; 206/121; 206/127; 206/96; 206/216; 16/111.1; 16/110.1; 220/504

(58) Field of Classification Search
USPC ..... 206/137, 96, 121, 127, 134, 86, 94, 206/90, 101, 119, 216, 236; 220/752, 761, 220/753, 771; 44/540, 511, 519, 507, 510, 44/506; 16/111.1, 110.1
See application file for complete search history.

(56) References Cited

U.S. PATENT DOCUMENTS

| | | | | | |
|---|---|---|---|---|---|
| 331,076 | A | * | 11/1885 | Miller | 206/121 |
| 407,883 | A | * | 7/1889 | Wilder et al. | 44/540 |
| 729,818 | A | * | 6/1903 | Wattenberg | 206/137 |
| 742,711 | A | * | 10/1903 | Moore | 206/137 |
| 1,444,251 | A | * | 2/1923 | Kirkbride | 206/121 |
| 1,451,195 | A | * | 4/1923 | Bagley | 431/202 |
| 1,600,622 | A | * | 9/1926 | Casaccia | 221/140 |
| 1,613,661 | A | * | 1/1927 | Laing | 206/86 |
| 1,638,222 | A | * | 8/1927 | Spring | 221/220 |
| 1,683,851 | A | * | 9/1928 | Wells | 206/236 |
| 2,601,455 | A | * | 6/1952 | Porter | 294/99.1 |
| 2,822,204 | A | * | 2/1958 | Stegner | 294/92 |
| 3,781,051 | A | * | 12/1973 | Gibson et al. | 44/540 |
| 4,424,018 | A | * | 1/1984 | Lowther, Sr. | 431/288 |
| 4,497,401 | A | * | 2/1985 | Ackerman | 206/131 |
| 4,563,029 | A | * | 1/1986 | Luberacki | 294/99.1 |
| 6,942,091 | B1 | * | 9/2005 | Alderson | 206/137 |
| 2012/0023702 | A1 | | 2/2012 | Bussone | |

* cited by examiner

*Primary Examiner* — Vivek Koppikar
*Assistant Examiner* — James Way

(57) ABSTRACT

My match container and striker for a match handle or holder enables self-sufficient functionality. It does so by incorporating match containment and striking within the application device itself. No secondary component such as a disconnected box of matches is necessary. Within one device a match can be lit and applied with convenience, efficacy, and safety.

2 Claims, 2 Drawing Sheets

MATCH CONTAINER AND STRIKER FOR A MATCH HANDLE

CROSS-REFERENCE TO RELATED APPLICATIONS

Ser. No. 13/151,212

FEDERALLY FUNDED RESEARCH

Not Applicable

SEQUENCE LISTING OR PROGRAMS

Not Applicable

BACKGROUND OF THE INVENTION

1. Field

This application relates to the mechanical holding of a match throughout its use.

2. Prior Art

The prior art involves a user holding an entirely flammable match while aflame. If the user holds the match long enough there is a risk of being burned. Longer matches help reduce this risk and aid in effective application. However they are costly and wasteful. The majority of such a match is wasted with each use. Devices identified as a match holder or match handle have been disclosed in prior art to address this deficiency. These devices are designed to hold a match while in use. However none of these devices include a means by which to integrate a match container or striker. These devices have been identified as both a match holder and match handle. For the purposes of this disclosure the term match handle will be used to encompass all such devices.

Several types of match holders are described in U.S. patents. The Wilder U.S. Pat. No. 407,883, Stegner U.S. Pat. No. 2,822,204, Gibson et al U.S. Pat. No. 3,781,051, and Luberacki U.S. Pat. No. 4,563,029 all disclose devices for holding a match while in use. None however provide an integral means by which to contain and strike matches.

The Bussone U.S. Pat. Application No. 13,151,212, by the present inventor, discloses a match handle with advantages over the prior art. It presents these advantages independent of a match container and striker.

SUMMARY

In accordance with one embodiment my match container and striker for a match handle enables self-sufficient functionality of a match handle. Incorporating match containment and striking with a match handle enables a fully equipped device. No secondary component such as a disconnected box of matches is necessary. This prevents a match handle from being without matches to make it functional. It also supports efficiency as handling of all essential elements is integrated. Additionally, a more substantial device body to grip during use is provided.

Match handles or holders have been described in prior art, however none provide all the benefits of this disclosure. My match container and striker provide a means of storing matches with a match handle or holder, and striking a match by means of the device itself. These and other benefits are provided in a practical and user friendly manner.

DRAWINGS

Figures

Figure 1:
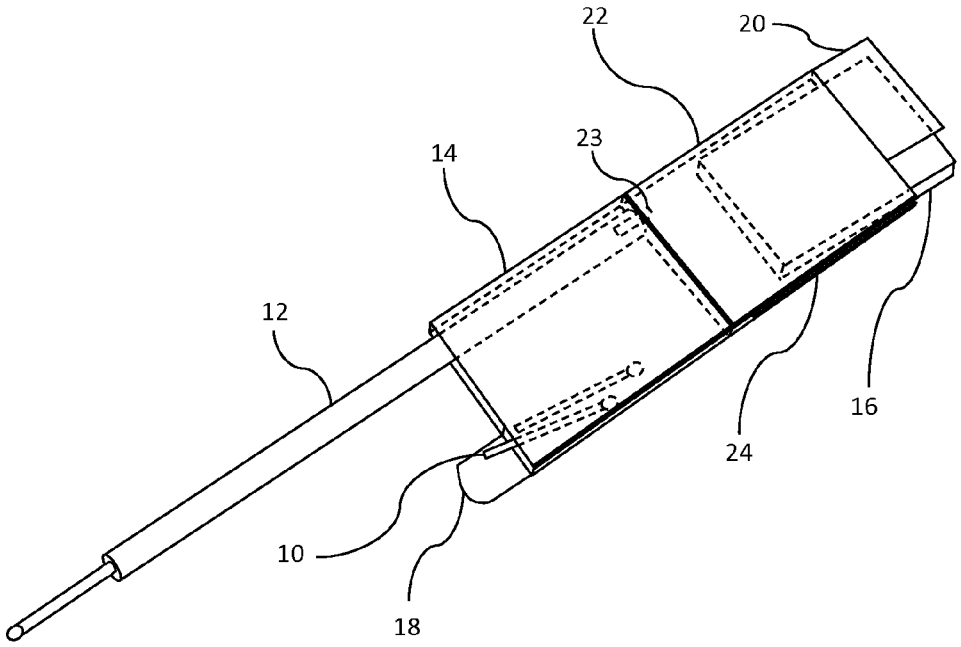
Figure 2:
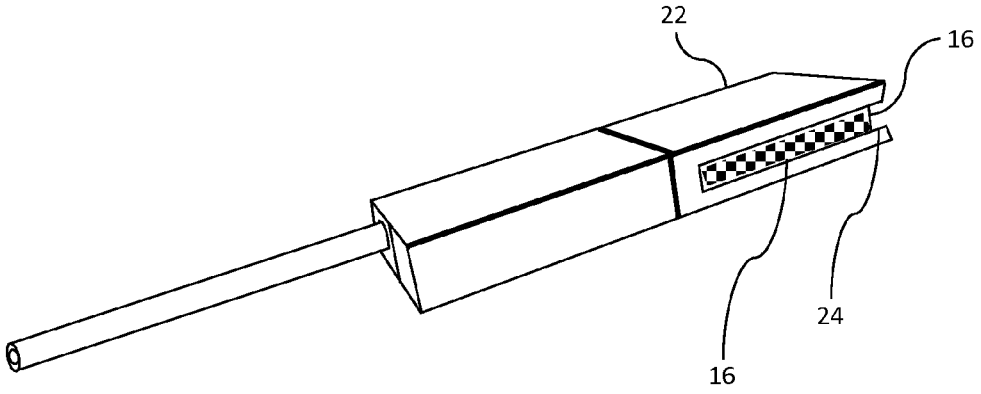
Figure 3:
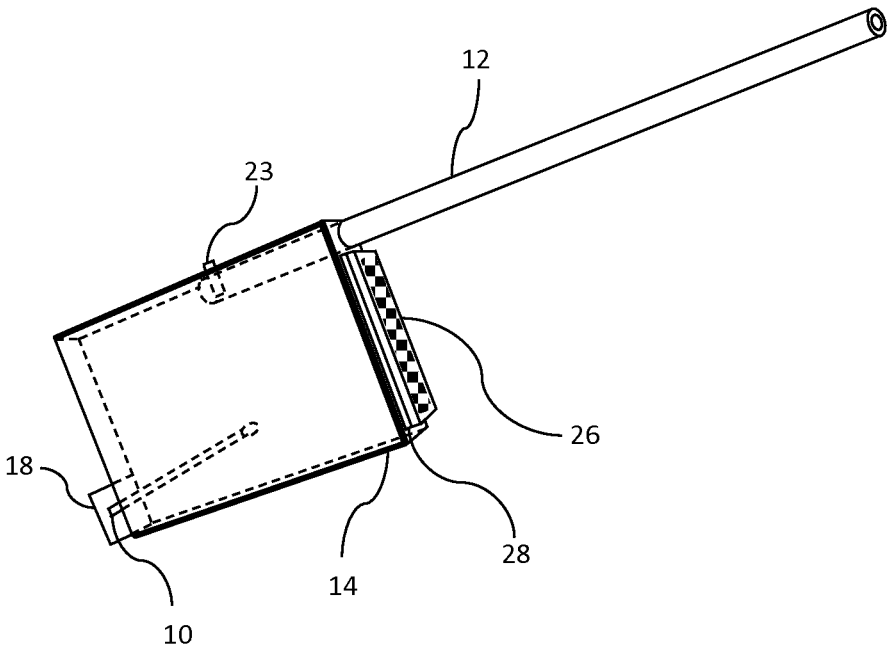

The following Figures are included:

FIG. 1: is a perspective view of a match handle with a compartment for match storage and another for storing a replaceable striker, shown with a partially exploded match and striker FIG. 2: is a perspective view of the embodiment of FIG. 1 emphasizing exposure and utility of a match striking surface FIG. 3: is a perspective view of a match handle with a compartment for match storage and a magnetically attached striker

REFERENCE NUMERALS

10 prior art matches
12 prior art match handle
14 a match container
16 prior art match box used as a striker
18 a hinged lid for a match container
20 a hinged lid for a striker container
22 a striker container
23 prior art screw
24 a striker slot in container to allow for match striking without removal of striker
26 a magnetic striker
28 a magnetic strip attached to a match container

DETAILED DESCRIPTION

First Embodiment—FIG. 1 and FIG. 2

A match handle 12 is shown in FIG. 1 with a set of matches 10 in an integrated match container 14. It is shown in a perspective view in FIG. 2 to display a striker 16. FIG. 1 shows a hinged lid 18 attached to match container 14. It also shows a hinged lid 20 attached to a striker container 22. To assembly the embodiment of FIG. 1 two equal sized hinge-top plastic containers at attained. It is presently contemplated to use rectangular polypropylene hinge-top containers with relative outside dimensions of 16×43×59 millimeters. One container is used for match container 14 and is connected to another used as striker container 22. They are connected by screws, adhesive, welding, or another suitable means. They are connected end-to-end to create an assembly that can be comfortably held by hand. The hinged openings will face opposite directions. Match handle 12 is then connected to match container 14 by a means suitable for the match handle being integrated. This will vary depending on the match handle geometry and will be evident to one skilled in the art. This embodiment shows the match handle 12 passing through a hole in the face of the match container 14. It is then held by a screw 23 at one end of match handle 12. Striker container 22 will then have a striker slot 24 cut into to it. This can be accomplished by a razor knife, thin powered grinding wheel, or another suitable means. Once these components are assembled matches 10 are loaded into match container 14. A striker 16 is loaded into striker container 22. In this embodiment a conventional 32 count penny match box is accommodated as striker 16. This affords easy replacement.

Construction of this embodiment involves the following primary steps:

1. Two equal sized hinge-top plastic containers at attained. It is presently contemplated to use rectangular polypropylene hinge-top containers with relative outside dimensions of 16×43×59 millimeters. One container is used for match container 14 and is connected to another used as striker container 22. They are connected by screws, adhesive, welding, or another suitable means. They are connected end-to-end to create an assembly that can be comfortably held by hand. The hinged openings will face opposite directions.

2. Match handle 12 is then connected to match container 14 by a means suitable for the match handle being integrated. This will vary depending on the match handle geometry and will be evident to one skilled in the art. This embodiment shows the match handle 12 passing through a hole in the face of the match container 14. It is then held by a screw 23 at one end of match handle 12.
3. Striker container 22 will then have a striker slot 24 cut into to it. This can be accomplished by a razor knife, thin powered grinding wheel, or another suitable means.
4. Once these components are assembled matches 10 are loaded into match container 14. A striker 16 is loaded into striker container 22. In this embodiment a conventional 32 count penny match box is accommodated as striker 16. This affords easy replacement.
5. The device is now ready for use.

Although specific materials, sizes, forms, and other details are currently contemplated in the description of this embodiment, various other materials, sizes, forms, etc. may be applied. Particularly, the use of pre-formed hinge-top plastic containers could be replaced with a single injection molded body. This body could include both container sections and all necessary features.

Operation

First Embodiment—FIG. 1 and FIG. 2

My match container and striker enable efficient functionality of a match handle. To achieve this, a match is selected from the match container from the hinge-top opening. The user can then strike the match on the integrated striker. The match can then either be inserted into the match handle or be applied independently if convenient.

It can also be used by selecting a match from the match container and inserting into the match handle before striking. The user can then remove the striker from its container and strike the match on the striker while the match is being held by the match handle. The striker is then replaced back in the striker container.

Operation of this embodiment involves the following steps:

1. A match is selected from the match container
2. It is struck on the striker while the striker remains in the striker container
3. The match is then inserted into the match handle, or applied directly if convenient Operation of this embodiment may alternatively involve the following steps:

1. A match is selected from the match container
2. The match is then inserted into the match handle
3. The striker is drawn from the striker container
4. The match is then struck on the striker while being held in the match handle

Detailed Description

Second Embodiment—FIG. 3

A match handle 12 is shown in FIG. 3 with a set of matches 10 in an integrated match container 14. FIG. 3 shows a hinged lid 18 attached to match container 14. Also shown is a magnetic strip 28 used to attach a striker 26 to match container 14. To assembly the embodiment of FIG. 3 a match handle 12 is connected to match container 14 by a means suitable for the match handle being integrated. This will vary depending on the match handle geometry and will be evident to one skilled in the art. This embodiment shows the match handle 12 passing through a hole in the face of the match container 14. It is then held by a screw 23 at one end of the match handle 12. Magnetic strip 28 is then attached by adhesive or other suitable means to match container 14. Striker 26 is then created by applying a match strike surface to a magnetic strip, such as a thin sheet of steel. It is presently contemplated that steel shim stock be used. The match strike surface can be cut from a conventional box of matches or produced from raw materials. Once all components are assembled the match container 14 is loaded with matches 10. The striker 26 is attached to magnetic strip 28 and the device is ready for use.

Construction of this embodiment involves the following primary steps:

1. A hinge-top plastic container is used as match container 14. The embodiment currently contemplates using a rectangular shape container. It should have a suitable length to hold matches 10. It is connected to match handle 12 by a means suitable for the match handle being integrated. This will vary depending on the match handle geometry and will be evident to one skilled in the art. This embodiment shows the match handle 12 passing through a hole in the face of the match container 14. It is then held by a screw 23 at one end of the match handle 12.
2. Magnetic strip 28 is attached to match container 14. This embodiment currently contemplates using conventional magnetic strip with adhesive backing.
3. Striker 26 is constructed by attaining a thin piece of magnetic material. This could also be magnetic strip with adhesive backing, or a piece of steel shim stock. A piece of match strike surface is cut from a conventional box of matches. These two pieces are then bonded by adhesive or other suitable means.
4. Striker 26 is then attached to magnetic strip 28 and match container 14 is loaded with matches 10.
5. The device is now ready for use.

Although specific materials, sizes, forms, and other details are currently contemplated in the description of this embodiment, various other materials, sizes, forms, etc. may be applied.

Operation

Second Embodiment—FIG. 3

A match is selected from the match container from the hinge-top opening. The user can then strike the match on the integrated striker. The match can then either be inserted into the match handle or be applied independently if convenient.

It can also be used by selecting a match from the match container and inserting into the match handle before striking. Follow by removing the striker from the magnetic strip. The user can then strike the match on the striker while the match is being held by the match handle. The striker is then replaced back on the magnetic strip.

Operation of this embodiment involves the following steps:

1. A match selected from the match container
2. It is struck on the striker while the striker remains attached to the match container
3. The match is then inserted into the match handle, or applied directly if convenient Operation of this embodiment may alternatively involve the following steps:

1. A match selected from the match container
2. The match is then inserted into the match handle
3. The striker is removed from the magnetic strip
4. The match is then struck on the striker while being held in the match handle

CONCLUSION, RAMIFICATIONS, AND SCOPE

According to the disclosed, I have provided means to integrate a match container and striker with a match handle or holder. While the above description contains many specifications, these should not be construed as limitations on the scope of any embodiment. They serve only as exemplifications of the presently preferred embodiments. Many ramifications and variations are possible within the teachings of this disclosure. For example:

The containers could be composed of shapes other than rectangular. These could include, but are not limited to; circular, square, triangular, or hexagonal cross-sections. Alternate shapes and configurations could also include means to provide for alternate holding methods of the device by the user.

Various closure mechanisms could be employed other than a hinge-top for the containers. These could include, but are not limited to; a sliding lid, a threaded cap, a squeezable opening, etc.

An additional match container could be included specifically for used matches.

The arrangement of the match container and striker container could take various other forms. For instance, the striker container could be toward the front, with the match container toward the rear of the device. The two containers could be side-by-side, as opposed to end-to-end. They could also be in an over-under configuration. These and many other configurations could be applied within the scope of this disclosure.

The magnetically attached striker could be on any other surface than what is shown in FIG. 3 of the device. This could include an internal container surface.

The magnetically attached striker could be attached by other means than magnetic force. These could include, but are not limited to; Velcro® or similar material, snap button(s), a tongue-and-groove interface, etc.

The match handle could be detachable from the match container and striker assembly.

A striker could also be contained within the match container along with the matches as opposed to having a separate container or being attached to the outside surface.

A striker, utilizing a conventional match box, could also be attached by means of a boss that a match box sleeve can slide over.

A striker surface could be directly adhered to the match container or match handle body.

The lid for one or more containers of the device could be attached by a means other than a hinge. A lid could slide within and be retained by grooves or similar means. A lid could also be free to be removed from its respective container.

The containers could be fabricated from raw materials as opposed to using preformed containers. Particularly injection molding could be used to produce the container components. This could be as a single unit or multiple components to be assembled.

Similar ramifications and variations to the ones listed would be obvious to one skilled in the art. Thus the scope of the disclosed should be determined by the appended claims and their legal equivalents, and not by the examples given.

The invention claimed is:

1. An elongated match handle or holder having a match receiving opening at one end and a two compartment sleeve attached at a user held other end of said match handle or holder; a first compartment of said two compartment sleeve being sized to closely receive a conventional penny size match box; a slot in said first compartment aligning with and allowing access to the striker of said match box to allow manual ignition of a match; a hinged lid on said first compartment through which to allow manual retrieval of a match from said match box; a second compartment of said two compartment sleeve having sufficient length to allow for containment of matches; a hinged lid through which to allow manual ignition or retrieval of matches from said second compartment.

2. An elongated match handle or holder having a match receiving opening at one end and a one compartment sleeve attached at a user held other end of said match handle or holder, said compartment being sized to closely receive a conventional penny sized match box; a slot in said compartment aligning with and allowing access to the striker of said match box to allow manual ignition of a match; a hinged lid allowing access to said compartment through which to allow manual retrieval of matches from said match box.

* * * * *